US006205922B1

(12) United States Patent
Henry et al.

(10) Patent No.: US 6,205,922 B1
(45) Date of Patent: Mar. 27, 2001

(54) REVERSIBLE PRINTING BLANKET

(75) Inventors: Jean-Luc Henry, Colmar; Gérard Rich, Orschwihr; Frédéric Soufflet, Chateaugiron, all of (FR)

(73) Assignee: Rollin S.A. (FR)

( * ) Notice: Subject to any disclaimer, the term of this patent is extended or adjusted under 35 U.S.C. 154(b) by 0 days.

(21) Appl. No.: 09/180,239

(22) PCT Filed: May 9, 1997

(86) PCT No.: PCT/FR97/00831

§ 371 Date: Mar. 16, 1999

§ 102(e) Date: Mar. 16, 1999

(87) PCT Pub. No.: WO97/43130

PCT Pub. Date: Nov. 20, 1997

(30) Foreign Application Priority Data

May 10, 1996 (FR) ..... 96 05864

(51) Int. Cl.[7] ..... B41N 10/04

(52) U.S. Cl. ..... 101/376; 428/909

(58) Field of Search ..... 101/217, 375, 101/376, 401.1, 492, 493; 428/909; 492/50–52, 56

(56) References Cited

U.S. PATENT DOCUMENTS

| | | | | |
|---|---|---|---|---|
| 668,919 | * | 2/1901 | Hill et al. | 428/909 |
| 3,652,376 | * | 3/1972 | Bowden, III | 428/909 |
| 5,006,400 | * | 4/1991 | Pinkston et al. | 428/909 |
| 5,347,927 | * | 9/1994 | Berna et al. | 101/375 |
| 5,352,507 | * | 10/1994 | Bresson et al. | 428/909 |
| 5,366,799 | * | 11/1994 | Pinkston et al. | 428/909 |
| 5,456,171 | * | 10/1995 | Biava et al. | 101/122 |

FOREIGN PATENT DOCUMENTS

| | | | | |
|---|---|---|---|---|
| 2244765 | * | 3/1974 | (DE) | 428/909 |
| 154089 | * | 11/1981 | (JP) | 428/909 |

* cited by examiner

*Primary Examiner*—Stephen R. Funk
(74) *Attorney, Agent, or Firm*—Woodcock Washburn Kurtz Mackiewicz & Norris

(57) ABSTRACT

A reversible printing blanket to be used with offset printing machines. The reversible printing blanket has two opposing lithographic printing faces. The blanket comprises a first external lithographic layer providing a first printing face, a second external lithographic layer providing a second printing face, and at least one compressible layer between the lithographic layers. Such reversible printing blanket allows impressions to be made by both sides of the blanket in such a way as to permit two separate printing jobs.

26 Claims, 1 Drawing Sheet

REVERSIBLE PRINTING BLANKET

This application is a 35 USC 371 national application of PCT/FR 97/00831 filed May 9,1997.

FIELD OF THE INVENTION

This invention pertains to a reversible printing blanket to be used with offset printing machines.

BACKGROUND OF THE INVENTION

Many types of printing blankets have long been used. These blankets consist essentially of a layer of compressible material such as cellular rubber to which a lithographic layer capable of producing an impression on a surface, for example, paper, is attached.

These designs present a number of drawbacks, among which we should note sagging due to loss of resiliency, blanket overheating during the printing process, the risk of destabilizing the offset balance during the process, paper flow control problems and vibrations in rapid rotary press machines.

Furthermore, the blankets currently in use are too specialized and can only be used under optimal quality control conditions to the extent that one often needs to use as many different types of printing blankets as there are types of printing to produce The goal then of this device is to eliminate the aforementioned drawbacks by providing a reversible printing blanket whose structural symmetry allows it to reduce or eliminate the problems of sagging, overheating, paper flow control and vibration.

BRIEF DESCRIPTION OF THE INVENTION

So, this invention consists of an offset printing blanket characterized by at least one layer of compressible material sandwiched between two external lithographic layers which render the blanket reversible.

Another characteristic of this invention is that the blanket consists of two layers of compressible material. These layers are either both isotropic, both anisotropic or one layer is isotropic while the other is anisotropic.

It is thus understood that such a reversible blanket allows impressions to be made by both sides of the blanket in such a way as to permit two separate, unique printing jobs, each of which produces a high quality impression on a surface, such as paper. This procedure is always better than using only one single blanket with compromising structural properties which does not always yield satisfactory results.

A unique reinforcing layer is inserted between the blanket's two compressible layers, marking yet another property of the invention.

Furthermore, this blanket can include a control layer to control the flow of paper for printing. This layer is located between the compressible material and one of the two lithographic layers.

So, a characteristic of this blanket is that a paper flow control layer is inserted between one of the layers of compressible material and its associated lithographic layer while a second paper flow control layer is inserted between the other layer of compressible material and its respective lithographic layer.

Additionally, in the case of a single layer of compressible material, the layer will either be isotropic with a Young elasticity modulus of between 0.2 and 50 MPa or an anisotropic layer with a Young elasticity modulus of between 20 and 1000 MPa in the direction parallel to the blanket's orientation and between 0.2 and 50 MPa in the direction perpendicular to the blanket's orientation.

The Young elasticity modulus is preferably between 1.5 and 15 MPa if one layer of material is isotropic while the Young elasticity modulus for the layer of anisotropic material is between 200 and 500 MPa in the direction parallel to the blanket's orientation and between 1.5 and 15 MPa in the direction perpendicular to the blanket's orientation.

Furthermore, another characteristic of the blanket described here is that at least one of the two layers of isotropic compressible material has a Young elasticity modulus of between 0.2 and 50 MPa or that at least one of the two layers of anisotropic compressible material has a Young elasticity modulus of between 20 and 1000 MPa in the direction parallel to the blanket's orientation and between 0.2 and 50 MPa in the direction perpendicular to the blanket's orientation.

The Young elasticity modulus is preferably between 1.5 and 15 MPa for the layer or layers of isotropic material while the Young elasticity modulus for the layer or layers of anisotropic material is preferably between 200 and 500 MPa in the direction parallel to the blanket's orientation and between 1.5 and 15 MPa in the direction perpendicular to the blanket's orientation.

It should also be specified here that the layers of compressible material are between 0.2 and 0.8 millimeters thick.

The Young elasticity modulus of the two lithographic layers, whether they are the same or different, is between 1.5 and 50 MPa. They may be of the same or different thickness, but in either case their thickness shall be between 0.05 and 0.4 millimeters.

The aforementioned single reinforcement layer has a Young elasticity modulus of between 500 and 10,000 MPa in the direction parallel to the blanket's orientation while its thickness is between approximately 0.05 and 0.8 millimeters.

Furthermore, the aforementioned single reinforcement layer shall be made of a textile grid or a plastic polymer film. The plastic polymer film can be either single layered or multi-layered.

Additionally, the paper flow control layer or layers incorporated into this blanket shall have a Young elasticity modulus of between approximately 200 and 1000 MPa in the direction parallel to the blanket's orientation and a thickness of between approximately 0.05 and 0.4 millimeters.

It should also be noted that the paper flow control layer or layers shall be made of a fiber-reinforced elastomer.

The layers of compressible material are made of cellular rubber whose fibers are preferably oriented in the same direction as the blanket for the anisotropic layers.

BRIEF DESCRIPTION OF THE DRAWINGS

Many other characteristics and advantages of the invention shall become evident in the detailed description which follows and refers to the drawings included in the annex. For example.

DETAILED DESCRIPTION OF THE INVENTION

Figure 1:
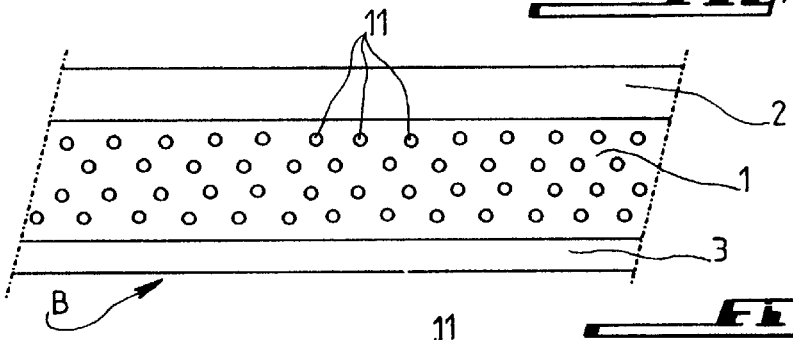
FIG. 1 shows a partial view and cross section of the blanket as described.

FIG. 1 shows an example of how this device can be produced. In accordance with the principles described, we see a blanket (B) with a layer of compressible material made of cellular rubber sandwiched between two external lithographic layers (2 and 3).

Thus blanket B is designed to be covered with, for example, an offset printing cylinder (not shown) and is reversible so as to permit impressions to be made on a medium such as paper, by one or both of the blanket's lithographic layers (2 and 3). In other words, with a blanket such as blanket B, there are two available printing surfaces which can have different properties for printing under different conditions depending on the type, elasticity modulus and thickness of layers 1, 2 and 3. For example, one could use the same blanket to print on blotting paper and glossy paper.

The layer of compressible material, 1, can be made of isotropic or anisotropic material. An isotropic material is one which exhibits the same properties (elasticity modulus) throughout all three geometric axes, x, y and z. Thus, in this example, layer 1 could be made of a simple layer of cellular rubber, in other words rubber having multiple empty pockets, as shown in 11, pockets which have an appropriate number and distribution pattern.

On the other hand, a compressible anisotropic material is one whose elasticity modulus vary across the three geometric axes x, y and z. Thus, in this case, compressible layer 1 could be made of cellular rubber containing fibers (not shown) preferentially oriented along the x axis parallel to blanket B's orientation, as is clearly shown in FIG. 5.

In the case where compressible layer 1 is isotropic, it shall have a Young elasticity modulus of between approximately 0.2 and 50 MPa, preferably between 1.5 and 15 MPa.

In the case where layer 1 is composed of a compressible anisotropic material, it shall have a Young elasticity modulus of between 20 and 1000 MPa, preferably between 20 and 500 MPa, on the x axis parallel to blanket B' orientation. The Young elasticity modulus should be between 0.2 and 50 MPa, preferably between 1.5 and 15 MPa, on the y axis (see FIG. 5) perpendicular to blanket B's orientation.

The layers of compressible isotropic or anisotropic material, 1, are between 0.2 and 0.8 millimeters thick.

The Young elasticity modulus of the two lithographic layers, whether they are the same or different, is between 1.5 and 50 MPa.

The lithographic layers, 2 and 3, can be of the same or different thickness, as shown in FIG. 1, where layer 2 is thicker than layer 3, which, as indicated previously, gives blanket B different printing capabilities to suit different type of print stock. The thickness of the layers shall be between 0.05 and 0.4 millimeters.

Figure 2:
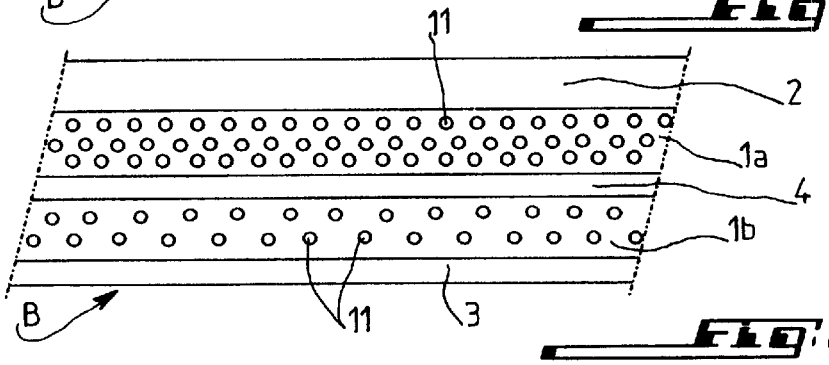
FIG. 2 shows a partial view and different cross section showing another possible implementation of this invention.

As shown in FIG. 2, the layer of compressible material is made of two distinct layers, 1*a* and 1*b*, which sandwich a single reinforcing layer, 4.

Layers of compressible material 1*a* and 1*b* may both be isotropic or anisotropic, or one layer may be isotropic while the other is anisotropic. The Young elasticity modulus of layers 1*a* and 1*b* shall fall within the range of values previously cited when the design is produced as shown in FIG. 1 with a single layer, 1, of compressible isotropic or anisotropic material. For this reason the values will not be repeated here. Likewise, lithographic layers 2 and 3 may be of identical thickness or of different thickness as explained with regards to FIG. 1. As previously indicated, they shall be between approximately 0.05 and 0.4 millimeters thick.

Compressible layers 1*a* and 1*b* shall also be between approximately 0.2 and 0.8 millimeters thick, as is the case for compressible layer 1 shown in FIG. 1.

Figure 5:
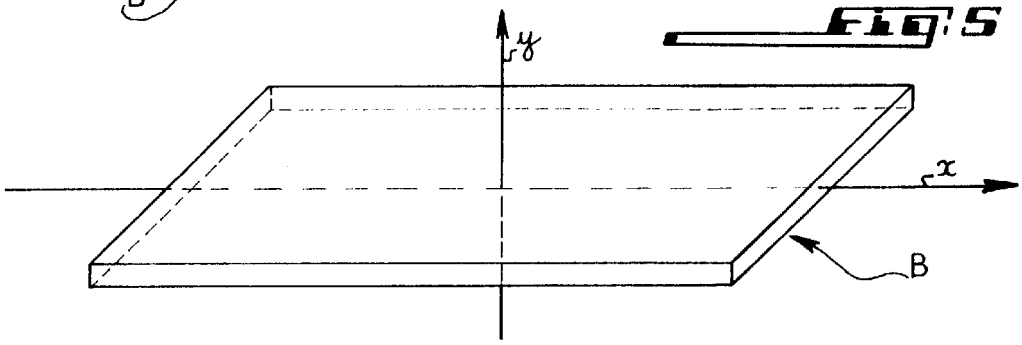
FIG. 5 is a schematic diagram showing the two principal directions of elasticity, one of which is parallel to the blanket's orientation and the other is perpendicular to the blanket's orientation.

The single reinforcing layer, 4, sandwiched between compressible layers 1*a* and 1*b* shall have a Young elasticity modulus of between approximately 500 and 10,000 MPa throughout the x axis parallel to the orientation of blanket B (see FIG. 5).

Reinforcing layer 4 can be made of a textile grid or of a plastic polymer film such as polyester or polycarbonate and can consist of one or more layers. It shall be between approximately 0.05 and 0.8 millimeters thick.

This type of reinforcing layer, 4, offers the advantage of reducing the thickness of the blanket which maximizes the ability to roll and distribute it. Indeed, this blanket can be distributed in rolled form to printers who in turn cut it into the appropriate size and shape to fit their offset printing presses, which operate with various and disparate formats.

Figure 3:
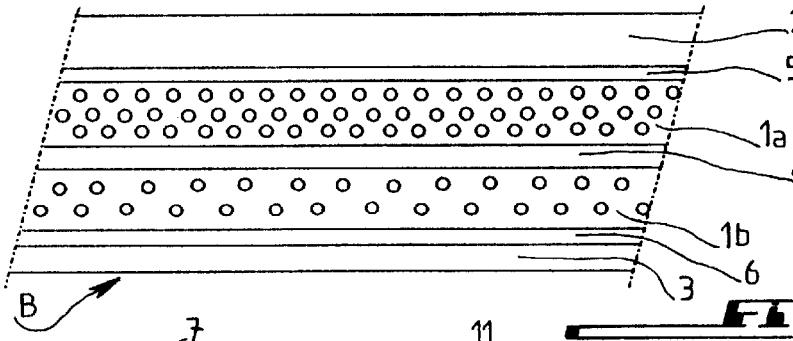
FIG. 3 provides a view similar to those of the preceding figures, but shows a different variation of the blanket as it could be implemented.

In the variation of the blanket shown in FIG. 3, we see this version of the blanket is quite similar to that in FIG. 2. It includes the addition of one paper (not shown) flow control layer, 5, sandwiched between the layer of compressible material, 1*a*, and the lithographic layer, 2, and a second paper flow control layer 2 sandwiched between the other layer of compressible material, 1*b*, and lithographic layer 3.

These paper flow control layers, 5 and 6, have a Young elasticity modulus of between approximately 200 and 1000 MPa on the x axis parallel to blanket B's orientation.

These layers can be between approximately 0.05 and 0.4 millimeters thick. Furthermore, these two layers, 5 and 6, can be made of an appropriate elastomer reinforced by fibers.

Paper flow control is improved as a result of layers 5 and 6 because the reversibility of blanket B allows the linear speed of the output paper to be adjusted for a given constant rotational speed of the printing press.

A single paper flow control layer on one side of the single reinforcing later, 4, such as layer 5 or layer 6, could be used when building the design shown in FIG. 3 without deviating from the device described by this patent.

Figure 4:
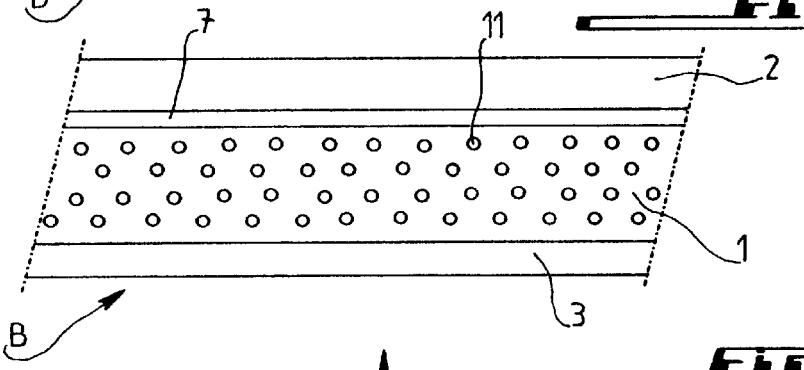
FIG. 4 also offers a view similar to that of the preceding figures and shows yet another possible form of this invention.

Referring to the variation of blanket B depicted in FIG. 4, we see this design is similar to that of FIG. 1 with the addition of the paper flow control layer, 7, sandwiched between the only layer of compressible material, 1, and one of the two opposing lithographic surfaces, 2 and 3.

This layer, 7, has the same thickness and elasticity characteristics as those defined above with reference to FIG. 3.

The various intervals described in FIG. 1 with regard to the elasticity and thickness of the layer of compressible isotropic or anisotropic material, 1, are the same for this layer as shown in FIGS. 2, 3 and 4, although it is understood that in FIGS. 2 and 3 the compressible layers, 1*a* and 1*b*, can be the same or different, as previously explained.

We also note that paper flow control layers 5, 6 and 7 are made of polymers which could be reinforced by fibers or textile.

Referring again to FIGS. 2 and 3, we see that by varying the compressibility and/or the thickness of layers 1*a* and 1*b*, we obtain different surface properties for the lithographic layers, which allows them to be adjusted for printing on different types of material with the same blanket, B.

Thus, this invention is a reversible printing blanket with two working surfaces which allow it to make high-quality impressions on various types of material, which was not possible in the past using printing blankets since they had only a single lithographic layer.

Furthermore, this blanket's symmetry resulting from the two opposing lithographic surfaces resolves the problem of sagging from lost resiliency, serious overheating problems which could disrupt the offset printing process as well as paper flow control problems and vibrations in rotary machines.

Finally, this blanket offers printers the advantage of avoiding the cost of stocking various types of printing blankets for printing on different surfaces as was the case with blankets having only one lithographic layer. This blanket can offer high-quality impressions on different types of surfaces. It is understood that production of this device is not limited to the designs illustrated here, as these descriptions were given as examples only.

All layers in the various types of blankets described and illustrated herein can be adhered to each other by any appropriate means not illustrated here, such as additional adhesive layers.

This invention includes all technical methods described and their equivalents and combinations thereof within the following claims:

What is claimed is:

1. A reversible printing blanket having two opposing lithographic printing faces, the blanket comprising a first external lithographic layer, a second external lithographic layer, and at least one compressible layer between said lithographic layers, wherein each of said first and second external lithographic layers has a thickness of from about 0.1 to about 0.4 mm thereby rendering each of said first and second external lithographic layers capable of providing a printing face that permits impressions to be made on a substrate.

2. A printing blanket of claim 1 having at least a second compressible layer between said lithographic layers.

3. A printing blanket of claim 2 in which both said compressible layers are isotropic.

4. A printing blanket of claim 2 in which both said compressible layers are anisotropic.

5. A printing blanket of claim 2 having at least one isotropic and at least one anisotropic compressible layer.

6. A printing blanket of claim 2 further comprising a reinforcing layer between said two compressible layers.

7. A printing blanket of claim 2, 3, 4, 5, or 6 further comprising a first paper control layer between said first lithographic layer and its adjacent compressible layer, and a second paper control layer between said second lithographic layer and its adjacent compressible layer.

8. A printing blanket of claim 7 in which each of said lithographic layers has a Young elasticity modulus between 1.5 and 50 MPa.

9. A printing blanket of claim 7 in which each of said paper control layers has a Young elasticity modulus between 200 and 1000 MPa in a direction within the plane of the blanket and a thickness between 0.05 and 0.4 millimeters.

10. A printing blanket of claim 7 in which at least one of said paper control layers comprises a fiber-reinforced elastomer.

11. A printing blanket of claim 3 in which at least one of said isotropic compressible layers has a Young elasticity modulus between 0.2 and 50 MPa.

12. A printing blanket of claim 4 in which at least one of said anisotropic compressible layers has a Young elasticity modulus between 20 and 1000 MPa in a direction within the plane of the blanket and a Young elasticity modulus between 0.2 and 50 MPa in the direction perpendicular to the blanket.

13. A printing blanket of claim 5 in which said isotropic compressible layer has a Young elasticity modulus between 0.2 and 50 MPa and said anisotropic compressible layer has a Young elasticity modulus between 20 and 1000 MPa in a direction within the plane of the blanket and a Young elasticity modulus between 0.2 and 50 MPa in the direction perpendicular to the blanket.

14. A printing blanket of claim 13 in which said isotropic compressible layer has a Young elasticity modulus between 1.5 and 15 MPa and said anisotropic compressible layer has a Young elasticity modulus between 200 and 500 MPa in a direction within the plane of the blanket and a Young elasticity modulus between 1.5 and 15 MPa in the direction perpendicular to the blanket.

15. A printing blanket of claim 3, 4, 5, 6, 13 or 14 in which said compressible layers each have a thickness between 0.2 and 0.8 millimeters.

16. A printing blanket of claim 6 in which the reinforcing layer has a Young elasticity modulus between 500 and 10,000 MPa in a direction within the plane of the blanket and a thickness between 0.05 and 0.8 millimeters.

17. A printing blanket of claim 16 in which the reinforcing layer is a textile grid, a single-layered plastic polymer film, or a multi-layered plastic polymer film.

18. A printing blanket of claim 1 in which the compressible layer is isotropic and has a Young elasticity modulus between 0.2 and 50 MPa.

19. A printing blanket of claim 1 in which the compressible layer is anisotropic and has a Young elasticity modulus between 20 and 1000 MPa in a direction within the plane of the blanket and a Young elasticity modulus of between 0.2 and 50 MPa in the direction perpendicular to the blanket.

20. A printing blanket of claim 18 or 13 in which said isotropic layer has a Young elasticity modulus between 1.5 and 15 MPa.

21. A printing blanket of claim 19 or 13 in which said anisotropic layer has a Young elasticity modulus between 200 and 500 MPa in a direction within the plane of the blanket and a Young elasticity modulus between 1.5 and 15 MPa in the direction perpendicular to the blanket.

22. A printing blanket of claim 1 further comprising a paper flow control layer between the compressible layer and one of the lithographic layers.

23. A printing blanket of claim 22 in which the paper control layer has a Young elasticity modulus between 200 and 1000 MPa in a direction within the plane of the blanket and a thickness between 0.05 and 0.4 millimeters.

24. A printing blanket of claim 1, 4, 5, 19, 12 or 13 in which the anisotropic compressible layer comprises cellular rubber.

25. A method for using a reversible printing blanket in offset printing comprising the steps of:

providing a printing blanket onto a printing cylinder, said printing blanket comprising a first external lithographic layer, a second external lithographic layer, and at least one compressible layer between said lithographic layers, wherein each of said first and second external lithographic layers have a thickness of from about 0.1 to about 0.4 mm thereby rendering each of said first and second external lithographic layers capable of providing a printing face that permits impressions to be made on a substrate, said second external lithographic layer being adjacent to said cylinder thereby defining a first position;

transferring an image from said first printing face of said first external lithographic layer to a first type of substrate;

flipping said printing blanket over such that said first external lithographic layer is adjacent to said cylinder thereby defining a second position; and transferring an image from said second printing face of said second external lithographic layer to a second type of substrate.

26. The method according to claim 25 wherein said first and second substrates are the same type of substrate.

* * * * *

UNITED STATES PATENT AND TRADEMARK OFFICE

CERTIFICATE OF CORRECTION

PATENT NO. : 6,205,922 B1
DATED : March 27, 2001
INVENTOR(S) : Jean-Luc Henry; Gérard Rich and Frédéric Soufflet It is certified that error appears in the above-identified patent and that said Letters Patent is hereby corrected as shown below:

Column 1,
Line 27, after "produce" insert -- . --

Column 4,
Line 34, after the word layer "2" should read -- 6 --

Signed and Sealed this

Sixteenth Day of October, 2001

*Attest:*

Nicholas P. Godici

*Attesting Officer*

NICHOLAS P. GODICI
*Acting Director of the United States Patent and Trademark Office*